United States Patent [19]

Atsukawa

[11] Patent Number: 5,056,278

[45] Date of Patent: Oct. 15, 1991

[54] EXTENSION SUPPORT UNIT

[75] Inventor: Masumi Atsukawa, Tokyo, Japan

[73] Assignee: K & M Enterprise Co., Ltd., Japan

[21] Appl. No.: 611,527

[22] Filed: Nov. 13, 1990

[30] Foreign Application Priority Data

Nov. 22, 1989 [JP] Japan ..... 1-301884

[51] Int. Cl.[5] ..... E04H 12/18

[52] U.S. Cl. ..... 52/108; 248/161

[58] Field of Search ..... 248/161, 188.5; 52/108, 52/111; 74/89.2, 89.15; 242/54 R; 182/41, 40

[56] References Cited

U.S. PATENT DOCUMENTS

| | | | |
|---|---|---|---|
| 2,733,885 | 2/1956 | Brown | 248/161 |
| 2,799,368 | 7/1957 | Alter | 52/108 |
| 3,007,014 | 10/1961 | Bentman | 248/161 X |
| 3,016,988 | 1/1962 | Browning | 52/108 X |
| 3,242,576 | 3/1966 | Wheeler | 52/108 X |
| 3,371,801 | 3/1968 | Widegren | 52/108 X |
| 3,457,685 | 7/1969 | Stein | 242/54 X |
| 4,651,480 | 3/1987 | Kramer | 182/41 X |
| 4,793,197 | 12/1988 | Petrovsky | 74/89.15 |
| 4,850,161 | 7/1989 | McGinnis | 52/111 X |
| 4,969,301 | 11/1990 | Warden | 182/40 |

*Primary Examiner*—J. Franklin Foss
*Attorney, Agent, or Firm*—Rogers & Killeen

[57] ABSTRACT

The extensible support pole unit having a simple structure including a plurality of shaped members, e.g., cylindrical bodies, band-like plates having, e.g., an arched cross-sectional shape, a band-like plate feed mechanism, and a driving device. The support pole is extended to stand or retracted by only paying out or winding up the band-like plates. The support pole can therefore be extended to a length freely selected, and it is possible to freely set a large extension ratio by selecting the length of each cylindrical body and the number of cylindrical bodies. The band-like plates have, for example, an arched cross-sectional shape and have properties such as to be strong against the vertical load as compared with flat plates. The band-like plates are retained in the guide slits or guide holes formed in the partition members disposed in the cylindrical bodies to further improving the above properties. With respect to the lateral load, the material, the diameter, the thickness of each cylindrical body, and the area of the connection portion of each cylindrical body are selected to maintain a sufficient strength. The influence of the lateral load upon the band-like plates is therefore negligible.

15 Claims, 5 Drawing Sheets

EXTENSION SUPPORT UNIT

BACKGROUND OF THE INVENTION

This invention relates to an extension support unit effective when used for photographing, picturing, monitoring, inspecting, measuring, repairing or observing, from a high place, sport games, various kinds of event, disaster scenes, important installations, industrial facilities, buildings, animals, plants, and other objects, or for illumination or radio wave relaying, or when used as a support for standing a high column such as an electric pole, an antenna mast, a cable way support, a tent support and the like.

Conventionally, as an ordinary means for these purposes, a fixed support pole is installed, a temporary scaffold is assembled or a special truck crane is used.

Some extension poles has been provided but the use of them is restricted because they have various shortcomings.

For example, if a fixed support pole is installed for illumination on a golf course in the nighttime according to the prior art, it impairs the view in the daytime and is inconvenient in terms of maintenance. Also, the provision of a structure capable of resisting a wind force at a speed of, e.g., 60 m/sec in conformity with a regulation is disadvantageous in terms of economy. In the case of assembly of a temporary scaffold, there are restrictions in terms of siting, assembly, and removal of the scaffold require a long time and a great deal of labor, and there are, therefore, the problems of poor economy and difficulty of speedy adaptation. Special apparatus including a truck crane are not widely applicable because they are disadvantageous in terms of cost and ease of use.

With respect to extension poles based on the conventional methods, in a pneumatic type or hydraulic type extension pole, a shielding for preventing leakage of the medium is required and the structure of the pole must be strong. It is therefore difficult to increase the length of the pole.

In other types of extension pole based on the method of utilizing a hinge, the slide method using a wire and the mechanical fitting method, the support structure is complicated and the length of the support pole and the load imposed on the pole are considerably limited.

SUMMARY OF THE INVENTION

It is an object of the present invention to provide an extension support unit which is capable of stably maintaining a sufficient strength when used for supporting a comparatively heavy object in a high position, for photography, picturing, illumination or transmission/reception at a high operating position which must be changed in height and location, or for working such as inspection, examination or repair at a high position, and which support unit also has suitable portability and operability.

To achieve this object, according to the present invention, there is provided an extension support unit having an extendable support pole formed by connecting a plurality of cylindrical bodies having different diameters, each of the cylindrical bodies having a smaller diameter being closely and movably inserted into another one of the cylindrical bodies having a larger-diameter, the smaller-diameter cylindrical body having a lower end outside diameter larger than an upper end inside diameter of the larger-diameter cylindrical body, the extension support unit comprising:

a) a partition member disposed in each of the cylindrical bodies, the partition member extending in a transverse direction of the cylindrical bodies, a top cover being provided on an uppermost end of one of the cylindrical bodies having the smallest diameter and located at the top of the support pole, one of the cylindrical bodies having the largest diameter located at a lowermost end of the support pole being made to stand on a machine chamber;

b) the partition member of each cylindrical body having at least one guide slit having an arched shape formed of a straight line or a curved line;

c) the machine chamber having at least one wind-up roll for winding up a band-like plate having an arched cross-sectional shape coinciding with the slit, at least one band-like plate feed mechanisms for paying out and drawing back the band-like plate by pinching same, and a device for driving the mechanisms;

d) the band-like plate having an arched sectional shape being made to pass through the guide slit having an arched sectional shape and formed in each of the partition members, the band-like plate being connected at its upper end to the top cover or a bottom portion of the cylindrical body having the smallest diameter and located at the uppermost end of the support pole;

e) the support pole being extended by rotating the band-like plate feed mechanism in a normal direction to pay out the band-like plate from the wind-up roll and to thereby lift the smallest-diameter cylindrical body located uppermost end of the support pole, by drawing up the second cylindrical body circumscribed about the smallest-diameter cylindrical body with the upward movement of the smallest-diameter cylindrical body, and by successively drawing up each larger-diameter cylindrical body with the smaller-diameter cylindrical body in this manner; and f) the support pole being contracted by rotating the band-like plate feed mechanism in a reverse direction to draw back the band-like plate previously paid out, to wind up the band-like plate around the wind-up roll and to draw down the second cylindrical body circumscribed about the smallest-diameter cylindrical body with the downward movement of the smallest-diameter cylindrical body, and by successively drawing down each larger-diameter cylindrical body with the smaller-diameter cylindrical body in this manner.

The present invention realizes extension functions of a large extension ratio by using a simple structure and also provides an effective structure strong against both the vertical and lateral loads.

That is, the unit of the present invention has a simple structure essentially consisting of a plurality of shaped members, e.g., cylindrical bodies, band-like plates having, e.g., an arched cross-sectional shape, a band-like plate feed mechanism, and a driving device.

The support pole is extended to stand or retracted and accommodated by only paying out or winding up the band-like plates. The support pole can therefore be extended to a length freely selected, and it is possible to freely set a large extension ratio by selecting the length of each cylindrical body and the number of cylindrical bodies.

The band-like plates used in accordance with the present invention have, for example, an arched cross-sectional shape and have properties such as to be strong against the vertical load as compared with flat plates. The band-like plates are retained in the guide slits or guide holes formed in the partition members disposed in the cylindrical bodies, thereby further improving the above properties.

With respect to the lateral load, the material, the diameter, the thickness of each cylindrical body, and the area of the connection portion of each cylindrical body are selected to maintain the sufficient strength. The influence of the lateral load upon the band-like plates is therefore negligible.

DESCRIPTION OF THE PREFERRED EMBODIMENT

An embodiment of the present invention will be described below with reference to the accompanying drawings.

Figure 1:
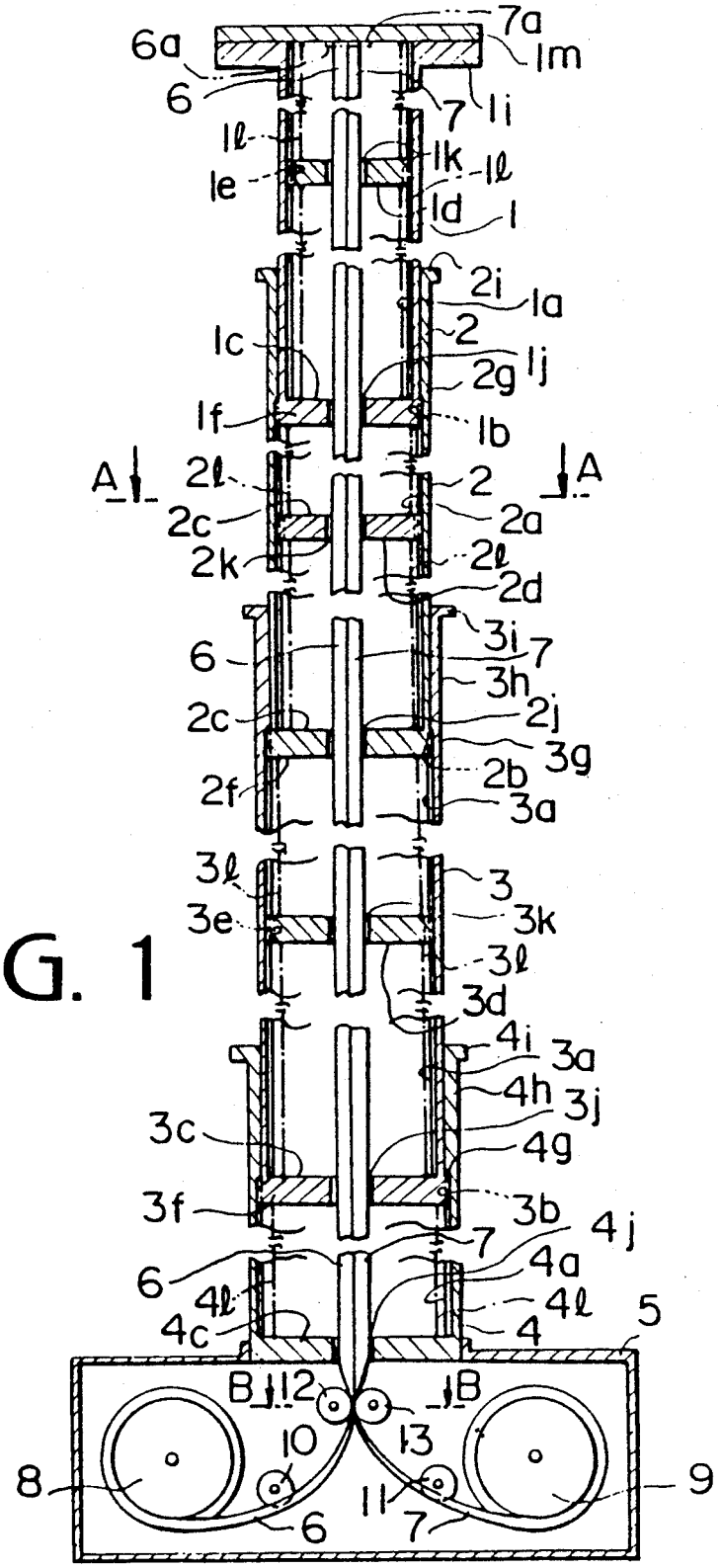
FIG. 1 is a cross-sectional view of a support unit in accordance with the present invention which is partially cut away so as to be reduced in the direction of height and which is shown in an assembled state.

Referring to FIG. 1, of hollow cylindrical bodies 1, 2, 3, and 4 having different diameters, the cylindrical bodies 1, 2, 3 of smaller diameters are successively inserted into the cylindrical bodies 2, 3, and 4 of larger diameters. On inner and outer surfaces of these smaller-diameter and larger-diameter cylindrical bodies are formed keys 2*a* to 4*a* parallel to the longitudinal direction of the cylindrical bodies, i.e., the sliding direction, and key grooves lb to 3*b* slidably fitted to the keys. (The places in which the key grooves are formed will be described later.) These keys and key grooves constitute rotation stoppers. Keys 1*a* are also formed in the inner surface of the smallest-diameter cylindrical body 1.

The cylindrical bodies 1 to 4 have bottom plates 1*c* to 4*c* provided as fixed partition members at their bottom ends, and at least one middle partition plates 1*d* to 4*d* provided as movable partition members inside the cylindrical bodies 1 to 4. The middle partition plates 1*d* to 4*d* are closely fitted in the cylindrical bodies so as to be parallel to the bottom plates 1*c* to 4*c* and to be movable in the longitudinal direction of the cylindrical bodies. The plate 4*d* is not shown in FIG. 1.

The middle partition plates 1*d* to 4*d* are positioned inside the cylindrical bodies 1 to 4 by being slid therein while being maintained in attitudes constantly parallel to the bottom plates 1*c* to 4*c*. In this embodiment, therefore, the attitudes of the middle partition plates 1*d* to 4*d* are maintained by the keys 1*a* to 4*a* formed in the inner circumferential surfaces of the cylindrical bodies 1 to 4 in the longitudinal direction of the same, and by key grooves 1*e* to 4*e* formed in the outer circumferential surfaces of the middle partition plates 1*d* to 4*d* and closely and movably fitted to the key threads 1*a* to 4*a*. Preferably, at least three keys are formed as each of the keys 1*a* to 4*a* by being arranged on the circumferential surface of the corresponding one of the cylindrical bodies 1 to 4 at equal intervals. In this embodiment, keys are formed in three places on each circumferential surface (refer to FIG. 3).

Lower end outer circumferential surfaces of the cylindrical bodies 1 to 3 and upper end inner circumferential surfaces of the cylindrical bodies 2 to 4 are formed as described below.

Figure 2:
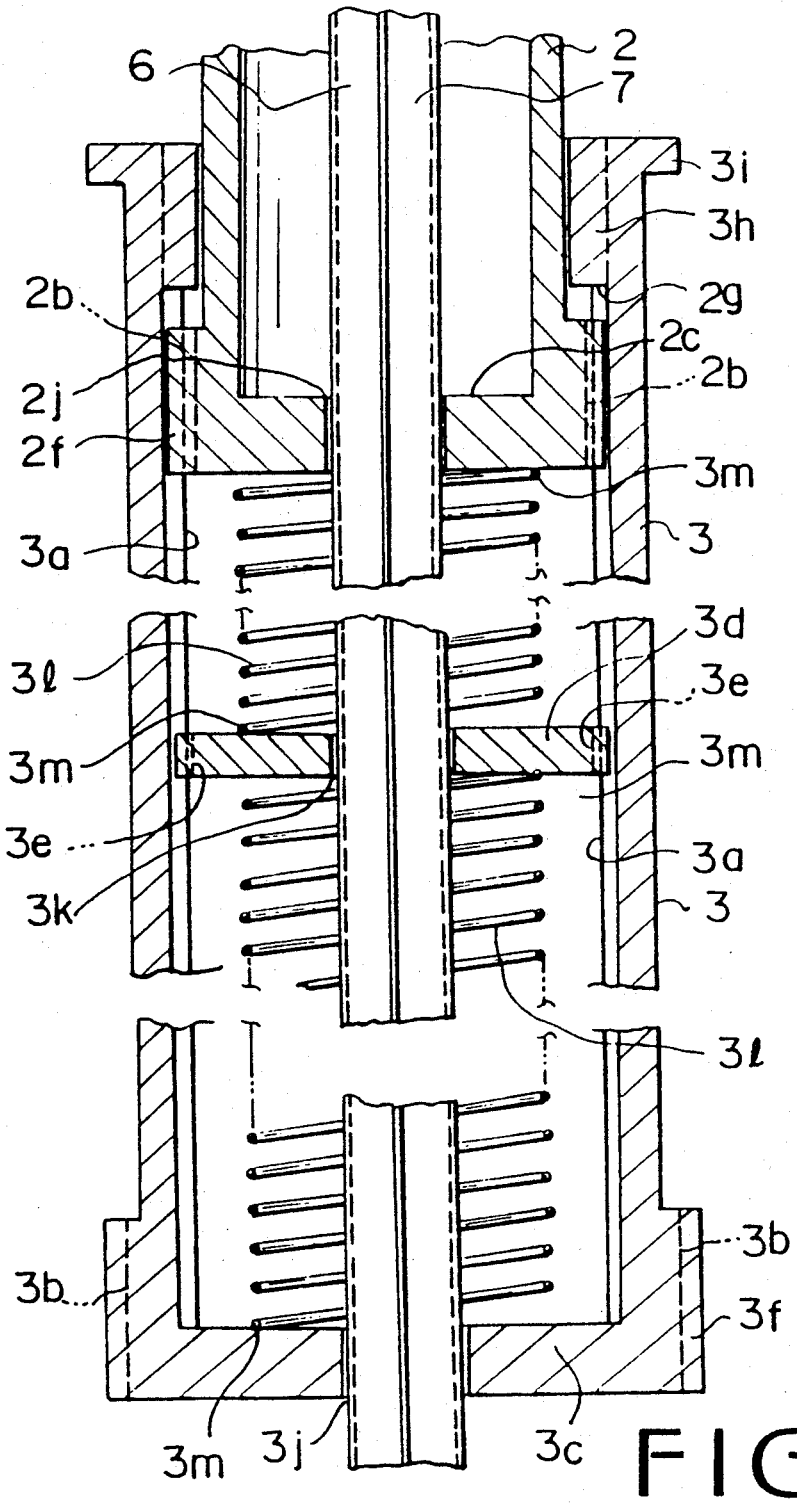
FIG. 2 is an enlarged diagram of a portion of the support unit shown in FIG. 1.

That is, in this embodiment, lower end flange portions 1*f* to 3*f* are formed on the lower end outer circumferential surfaces of the cylindrical bodies 1 to 3 by slightly increasing the diameters of the outer circumferential surfaces of the bottom plates 1*c* to 3*c* relative to the diameters of the other portions of the cylindrical bodies 1 to 3. The key grooves 1*b* to 3*b* are formed in the outer circumferential surfaces of the flange portions 1*f* to 3*f*. Thick connection portions 2*h* to 4*h* are formed on upper end inner circumferential surfaces of the cylindrical bodies 2 to 4. The thick connection portions 2*h* to 4*h* have step portions 2*g* to 4*g* formed at their lower ends and engagable with the lower flange portions 1*f* to 3*f* when these portions move upward. The thick connection portions 2*h* to 4*h* and the lower flange portions 1*f* to 3*f* may be formed by any method, for example, by fitting ring-like members provided separately from the main bodies of the cylindrical bodies 1 to 4, as shown in FIG. 2.

The operation of the above-described arrangement will be described below by way of example. When the cylindrical body 1 is moved upward until its lower flange portion 1*f* is brought into engagement with the step portion 2*g* of the cylindrical body 2, the cylindrical body 1 is moved together with the cylindrical body 2 having the step portion 2*g* in engagement with the cylindrical body 1 by the upward movement. Thus, when each smaller-diameter cylindrical body is moved upward, it is moved upward together with the larger-diameter cylindrical body in which that smaller-diameter cylindrical body is inserted by engaging its lower end flange portion with the step portion of the larger-diameter cylindrical body. In the illustration of the embodiment, only three cylindrical bodies 1 to 3 are shown as the cylindrical bodies capable of being moved upward. However, according to the present invention, the number of cylindrical bodies may be freely selected.

Upper flanges 1*i* to 4*i* are formed on upper end outer circumferential portions of the cylindrical bodies 1 to 4. The flanges 1*i* to 4*i* have a function such that when the cylindrical bodies 1 to 3 extended and made to stand by being moved upward moved are retracted and accommodated, i.e., when each smaller-diameter cylindrical body is accommodated in the corresponding larger-diameter cylindrical body, the lower surface of the upper flange of the smaller-diameter cylindrical body abuts against the upper surface of the larger-diameter cylindrical body to enable these cylindrical bodies to be moved downward together.

Since in the illustrated embodiment the largest-diameter cylindrical body 4 is not moved upward or downward, the flanges 1*i* to 3*i* of the cylindrical bodies 1 to 3 contracted are supported on the flange 4*i*.

In the present invention, the upper flanges 1*i* to 4*i* may be removed. In this case, the bottom plates 1*c* to 3*c* of the smaller-diameter cylindrical bodies 1 to 3 are successively brought into abutment against the bottom plates 2*c* to 4*c* of the larger-diameter cylindrical bodies 2 to 4, so that the cylindrical bodies are moved downward integrally with each other.

Figure 5:
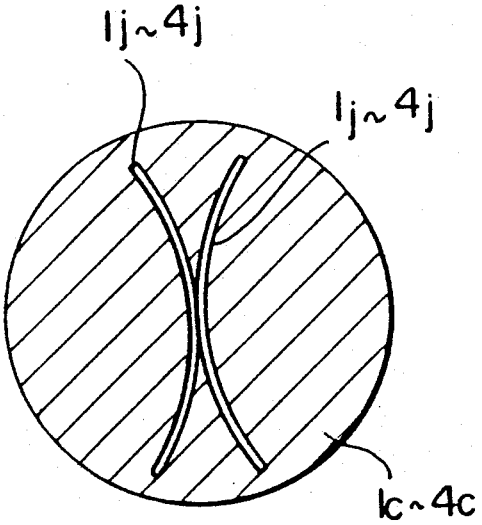
FIGS. 5, 6, and 7 are plan views of examples of arched slits formed in the bottom plate of each of the cylinders.

As shown in FIG. 5, pairs of guide slits 1*j* to 4*j* each having, for example, the shape of a large-radius circular arc as viewed in the plan of FIG. 5 are formed in the bottom plates 1c to 4c of the cylindrical bodies 1 to 4 in positions and a configuration symmetric on the centers of the bottom plates 1c to 4c. The shape of the guide slits as viewed in the plan is determined in conformity with the cross-sectional shape of band-like plates 6 and 7 described later.

Figure 3:
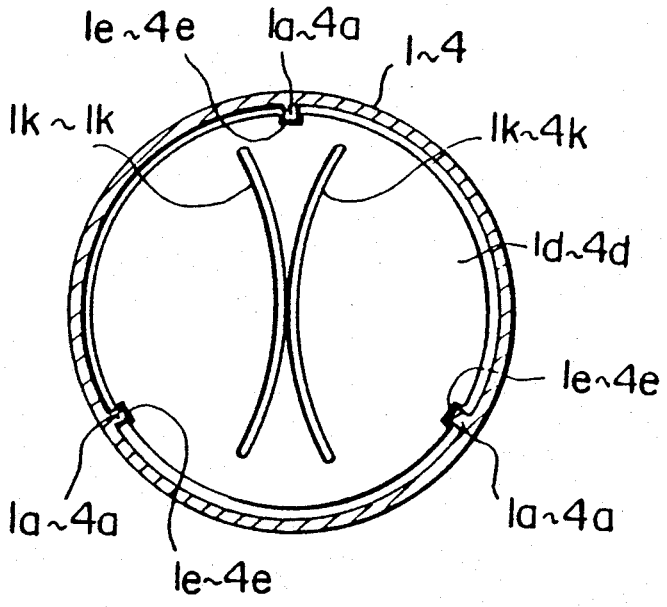
FIG. 3 is an enlarged cross-sectional view taken along the line A—A of FIG. 1.

Guide slits 1k to 4k similar to the guide slits 1j to 4j of the bottom plates 1c to 4c are formed in the middle partition plates 1d to 4d inserted in the cylindrical bodies 1 to 4, as shown in FIG. 3.

The middle partition plates 1d to 4d inserted in the cylindrical bodies 1 to 4 are supported thereinside in a state shown in FIG. 2, for example.

First, the middle partition plate 1d of the smallest-diameter cylindrical body 1 is supported between the lower surface of a top cover 1m and the bottom plate 1c in two directions from above and below by thin support members such as piano wires or hair coil springs 1l (indicated by the dot-dash line in FIG. 1) so as to be positioned in the longitudinal direction of the cylindrical body when the cylindrical body is extended. Similarly, each of the middle partition plates 2d to 4d of the cylindrical bodies 2 to 4 is supported between the upper bottom surface of the cylindrical body in which that middle partition plate is inserted and the lower bottom plate surface of the corresponding smaller-diameter cylindrical body in two directions from above and below by two of thin support members such as hair coil springs 2l to 4l (indicated by the dot-dash line in FIG. 1). The starting and terminal ends of the coil springs are fixed to the upper and lower surfaces of the bottom plates and the upper and lower surfaces of the middle partition plates. Examples of the fixed portions are indicated by 3m in FIG. 2.

The position of each of the middle partition plates 1d to 4d when the cylindrical bodies are extended is determined by previously calculating based on conditions including the number of the middle partition plates inserted in the cylindrical bodies and the lengths of the cylindrical bodies. Accordingly, in the cylinders 1 to 4, the position of each of the middle partition plates 1d to 4d on thin support members such as the springs 1l to 4l when attached to the thin support members is also determined previously.

When the cylindrical bodies 1 to 3 are retracted and accommodated in the cylindrical body 4, the middle partition plates 1d to 4d are accommodated in a state such as to be pinched between the bottom plates of the retracted cylindrical bodies.

In this embodiment, the four cylindrical bodies 1 to 4 of the above-described construction are extended or retracted by paying out or winding up the pair of the band-like plates 6 and 7 each having a large-radius-arc cross-sectional shape and provided in a machine chamber 5 formed below the cylindrical body 4 having the largest diameter and disposed in the lowermost position. Next, the cross-sectional shape of the band-like plates 6 and 7, the machine chamber 5 and an example of the structure for paying out and winding up the band-like plates 6 and 7 will be described below with reference to FIG. 1.

Figure 8A:
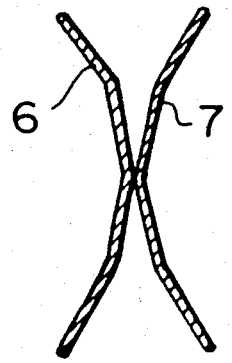
FIGS. 8(*a*) and 8(*b*) plan views of other examples of the sectional shape of band-like plates 6, and 7.
Figure 8B:
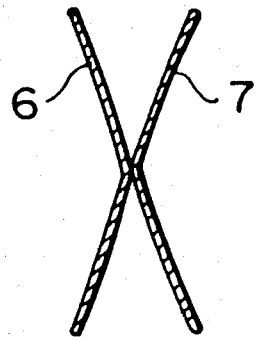

In this embodiment, the band-like plates 6 and 7 have a flat-surface width and an arched cross-sectional shape such as to be closely and movably fitted in the arched guide slits 1j to 4i, and 1k to 4k formed in the bottom plates 1c and 4c and the middle partition plates 1d to 4d. Alternatively, in accordance with the present invention, the band-like plates 6 and 7 may have, instead of an arched sectional shape, a polygonal arc-like sectional shape such as that shown in FIG. 8 approximate to a large-radius circular arc. That is, any cross-sectional shape may be selected so long as it is suitable for maintaining the desired buckling strength of the extended band-like plates.

In the machine chamber 5 are provided wind-up rolls 8 and 9 around which the band-like plates 6 and 7 having a large-radius-arc sectional shape are wound, guide rolls 10 and 11 for guiding the band-like plates paid out from or wound around the wind-up rolls 8 and 9, and a pair of drive rolls 12 and 13 for effecting wound-up or paid-out traveling of the band-like plates 6 and 7 while pinching the same in a back-to-back state.

Figure 4:
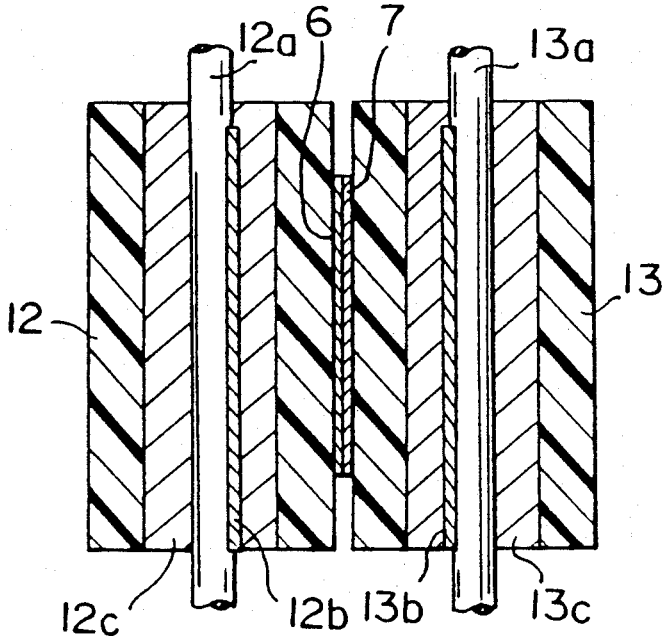
FIG. 4 is an enlarged cross-sectional view taken along the line B—B of FIG. 1.

Each of the drive rolls 12 and 13 has a cylindrical shape and is formed of a comparatively hard elastic material such as rubber; it can press and pinch the band-like plates 6 and 7 so that the band-like plates 6 and 7 are deformed as shown in FIG. 4.

Referring to FIG. 4, the drive rolls 12 and 13 have a width substantially larger than that of the band-like plates 6 and 7. Reference symbols 12a and 13a designate attachment shafts of the rolls 12 and 13, and reference symbols 12c and 13c designate metal cores integral with the drive rolls.

The width of the band-like plates 6 and 7 may be uniform through their overall length or may be reduced toward the extending ends so that the band-like plates are slightly tapered in accordance with the inside diameters of the cylindrical bodies.

The drive rolls 12 and 13 and, according to design requirements, the guide rolls 10 and 11 and the wind-up rolls 8 and 9 may be provided with driving motors (not shown) rotatable in each of the normal and reverse directions in synchronization with each other.

If the support pole is long and if the load imposed upon the top is large, a plurality of pairs of drive rolls 12 and 13 may be disposed along the band-like plates 6 and 7, and a belts may be wrapped round a row of the drive rolls disposed on the same side to drive the band-like plates 6 and 7.

The above-described components 8 to 13 constitute an example of the construction of pairs of rolls and the device for driving the same which form the mechanism for winding-up and paying out the band-like plates 6 and 7 in accordance with the present invention.

Ends 6a and 7a on the paid-out side of the pair of band-like plates 6 and 7 having an arched cross-sectional shape are successively led through the pairs of guide slits 4j to 1j formed in the bottom plates 4c to 1c of the cylindrical bodies 4 to 1 and each having an arched shape as viewed in plan, and the guide slits 1k to 4k of the middle partition plates 4d to 1d and are fixed to the lower surface of the top cover 1m provided at the top end of the smallest-diameter cylindrical body 1. Alternatively, the ends 6a and 7a of the band-like plates 6 and 7 may be fixed to the lower surface of the bottom plate 1c of the cylindrical body 1.

The top cover 1m is utilized as a portion on which each of various kinds of equipment is attached.

As described above, the unit in accordance with the embodiment of the present invention includes the cylindrical bodies 1 to 4 which are arranged so that the smaller-diameter cylindrical bodies are closely and movably inserted into the larger-diameter cylindrical bodies, the guide slits 1j to 4j formed into the shape of a large-radius arc in the bottom plates 1c to 4c of the cylindrical bodies 1 to 4 to guide the band-like plates 6 and 7, the guide slits 1*d* to 4*d* of the middle partition plates 1*d* and 4*d* for also guiding the band-like plates, the pair of band-like guide plates 6 and 7 having an arched sectional shape, extending through the slits 1*j* to 4*j*, and 1*k* to 4*k* and having its extreme ends connected to the smallest-diameter cylindrical body 1, and the wind-up/pay-out mechanism provided in the machine chamber 7 to wind up or pay out the band-like plates 6 and 7.

The number of middle partition plates provided in the cylindrical bodies is selected according to the length of the support pole, the load on the top, and so on. Also, the middle partition plates may be removed.

If the cross-sectional shape of the band-like plates 6 and 7 is a generally polygonal arc-like shape approximate to a circular arc (refer to FIG. 8), the guide slits 1*j* to 4*j*, and 1*k* to 4*k* of the bottom plates 1*c* to 4*c* and the middle partition plates 1*d* to 4*d* provided as members for partitioning the cylindrical bodies are shaped so that the band-like plates 6 and 7 can be closely and movably inserted into these slits having an angular arc-like shape.

The operation of the above-described support unit of the present invention will be described below.

When the cylindrical bodies 1 to 3 are accommodated in the cylindrical body 4 to set the unit in a fully contracted state, the cylindrical bodies 1 to 4 are contracted so that their upper flanges 1*i* to 4*i* are successively brought into contact with and placed on each other. Accordingly, at this time, the band-like plates 6 and 7 are also wound around the wind-up rolls 8 and 9.

To extend and stand the unit of the present invention from this contracted state, the wind-up/pay-out mechanism is driven and the band-like plates 6 and 7 wound around the rolls 8 and 9 are thereby paid out.

When paying-out the band-like plates 6 and 7 is started, the ends 6*a* and 7*a* of the band-like plates 6 and 7 start moving upward while the band-like plates 6 and 7 are being closely held in the guide slits 4*j* to 1*j* of the bottom plates 4*c* to 1*c* and the guide slits 4*k* to 1*k* of the middle partition plates 4*c* to 1*c*, thereby lifting the smallest-diameter cylindrical body 1 to which these ends are fixed. The middle partition plate 1*d* of the cylindrical body 1 is maintained in the predetermined position from the start and supports the band-like plates 6 and 7. When the lower end of the cylindrical body 1 reaches the upper thick connection portion 2*h* of the cylindrical body 2 during paying-out of the band-like plates 6 and 7, the lower flange portion 1*f* of the cylindrical body 1 is brought into contact with the engaging step portion 2*g* formed at the lower end the connection portion 2*h* of the cylindrical body 2, and the cylindrical body 1 continues moving upward with the cylindrical body 2.

When the flange portion 2*f* of the bottom plate 2*c* of the cylindrical body 2 is brought into contact with the step portion 3*g* of the cylindrical body 3, the cylindrical body 2, which has been moved upward, continues moving upward with the cylindrical body 3. When the flange portion 3*f* of the bottom plate 3*c* of the cylindrical body 3 is brought into contact with the step portion 4*g* of the largest-diameter cylindrical body 4, the extension setting of the illustrated support unit of the present invention is completed.

During the above-described process of lifting the cylindrical bodies 1 to 3, the middle partition plates 2*d*, 3*d*, and 4*d* located immediately above the bottom plates 2*c* to 4*c* of the cylindrical bodies 2 to 4 are drawn up by the upward movement of the hair coil springs 1*l* to 3*l* attached to the bottom plates 1*c* to 3*c* of the cylindrical bodies and are set to the predetermined positions in the cylindrical bodies.

For extension setting of the support unit of the present invention, the band-like plates 6 and 7 having an arched sectional shape have self-standing properties in the paid-out state because their cross-sectional shape is arched. Also, in accordance with the present invention, the band-like plates 6 and 7 stand in the extended state while being supported at the positions spaced apart with suitable pitches by the arched guide slits 4*j* to 4*k* formed in the bottom plates 4*c* to 1*c* of the cylindrical bodies 4 to 1 and the middle partition plates 4*d* to 1*d*. The band-like plates 6 and 7 therefore exhibit a sufficient buckling strength against the vertical load.

Lower portions of the cylindrical bodies 1 to 3 are connected to the thick connection portions 2*h* to 4*h* of the larger-diameter cylindrical bodies 2 to 4 by overlapping over a comparatively large vertical width. The effect of this connection and the improved buckling strength ensures that the support pole extending and standing has a sufficient strength against the lateral load.

In the above-described embodiment, circular-arc guide slits 1*j* to 4*j*, and 1*k* to 4*k* corresponding to the two band-like plates 6 and 7 are formed in the bottom plates 1*c* to 4*c* of the cylindrical bodies 1 to 4 and the middle partition plates 1*d* to 4*d*. However, according to the present invention, guide holes having circular-arc outer peripheral edges (not shown) may be formed instead of the slits 1*j* to 4*j* and 1*k* to 4*k*.

Figure 7:
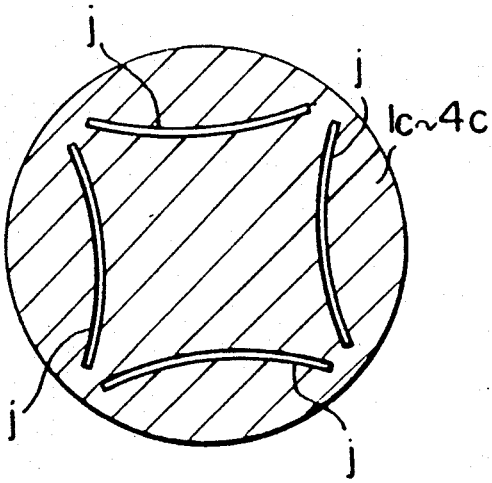
Figure 6:
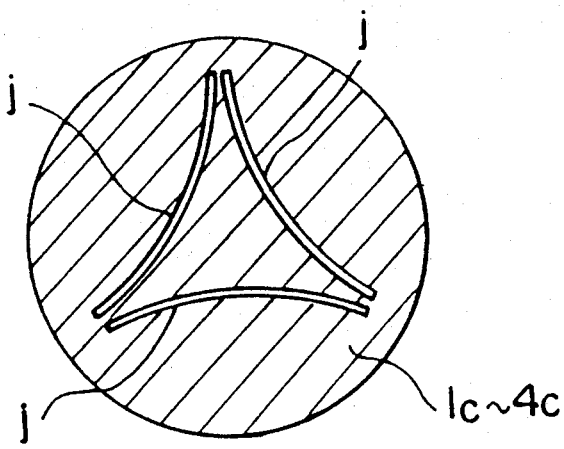

If three or four band-like plates 6 and 7 are provided, the guide slits may have a shape such as that represented by three or four arched slits j shown in FIG. 6 or 7, or may be the shape of guide holes surrounded by three or four arched sides (not shown). In such a case, the guide slits formed in the middle partition plates 1*d* to 4*d* are also modified to form a corresponding configuration (not shown).

In each of these examples of the guide slit arrangement, the arched guide slits are formed so that the convex sides of their arched shapes face each other. Alternatively, they may be formed so that the concave sides of their arched shapes face each other. Needless to say, in such a case, the band-like plates are disposed so as to face in the corresponding directions.

Next, the contracting operation of the support unit of the present invention thus constructed and extended to stand will be described below with reference to FIGS. 1 to 4.

In the state shown in FIG. 1 where the unit set in the extended state, the drive rolls 12 and 13 and the wind-up rolls 8 and 9 are driven in the winding-up direction to wind up the two band-like plates 6 and 7 set in the extended state.

When winding-up of the band-like plates 6 and 7 is started, the uppermost cylindrical body 1 first starts moving downward since the ends 6*a* and 7*a* of the band-like plates 6 and 7 are connected to the cylindrical body 1, the cylindrical body 2 then starts moving downward by its weight with its step portion brought into contact with the lower flange of the cylindrical body 1, and the cylindrical body 3 successively moves downward by its weight. That is, the cylindrical body is accommodated in the cylindrical body 2, the cylindrical body 2 in the cylindrical body 3, and the cylindrical body 3 in the cylindrical body 4; the cylindrical bodies are successively accommodated one into another and retracted by equal ratios. The cylindrical bodies 1 to 3 are finally accommodated in the cylindrical body and the unit is completely contracted.

When the cylindrical bodies 3 to 1 are moved downward, the middle partition plates 4*d* to 2*d*, which are supported by the hair coil springs 4*l* to 2*l* between the lower surface of the bottom plates 3*c* to 1*c* of the cylindrical bodies 3 to 1 and the bottom plates 4*c* to 2*c* of the cylindrical bodies 4 to 2 into which the former cylindrical bodies are inserted, are slid and moved downward in the cylindrical bodies 4 to 2 in which they are inserted, as the bottom plates of the cylindrical bodies 1 to 4 are moved closer to each other by the contraction/accommodation operation. When the contraction/accommodation operation is completed, the middle partition plates 4*d* to 2*d* are accommodated between the bottom plates of the cylindrical body adjacent to each other.

In the above-described embodiment, the cylindrical bodies are provided as the pole pipes. Alternatively, the pole pipes may have a different cross-sectional shape, e.g., a polygonal or oval shape. In the described embodiment also, the band-like plates are formed of steel. However, any other kind of material, e.g., a metal, a plastic or a metal-plastic composite material may be selected as the material of the band-like plates.

The above-described embodiment exemplifies an arrangement having no engagement retaining mechanism for maintaining the engagement for connection between the lower end of each smaller-diameter cylindrical body and the upper end connection portion of the larger-diameter cylindrical body in which the smaller-diameter cylindrical body is inserted. However, such an engagement retaining mechanism may be added as desired.

In accordance with the present invention, as described above, the support unit is constructed so as to be capable of being extended or contracted by paying out or winding up band-like plates having an arched cross-sectional shape. It can therefore be smoothly extended/contracted, can constitute a support pole having a large extension ratio, and can be formed as a unit having a strength sufficient for supporting a substantially large weight. The support unit of the present invention can be designed for resisting a substantial lateral load to be stable against strong wind.

Specifically, in the support unit of the present invention, the pole pipes support the lateral load to prevent application of the lateral load to the band-like plates disposed in the pole pipes, and the middle partition plates which have slits for guiding the band-like plates like the guide slits formed in the bottom plates or the fixed partition members of the pole pipes, and which are provided as movable partition plates capable of moving upward or downward in the pole pipes without inclining or rotating are inserted into the pole pipes to support the band-like plates moved upward or downward inside the pole pipes. When the unit is extended and made to stand, therefore, the band-like plates having an arched sectional shape are retained with short spans by the guide slits of the bottom plates of the pole pipes and the middle partition plates, so that the withstand load of the band-like plates can be maximized, thereby making it possible to realize an extension support unit having an improved strength.

Thus, the support unit of the present invention is very useful when applied to a portable support unit for various kinds of operation of inspection, examination, repair and the like effected by supporting a heavy object at a high level in a narrow place where a temporary scaffold cannot be assembled or construction poles cannot be installed, or where the high level operation vehicle cannot enter, or for outdoor working effected in a high place, e.g., radio wave relaying, illumination or photography.

When the support unit is not used, the component parts are accommodated in the machine chamber and the lowermost cylindrical body so that the overall unit size is reduced. Therefore the support unit of the present invention is very convenient in terms for transport and storage.

What is claimed is:

1. An extension support unit having an extendable support pole formed by connecting a plurality of cylindrical bodies having different diameters, each of said cylindrical bodies having a smaller diameter being closely and movably inserted into another one of said cylindrical bodies having a larger-diameter, said smaller-diameter cylindrical body having a lower end outside diameter larger than an upper end inside diameter of said larger-diameter cylindrical body, said extension support unit comprising:

a) a partition member disposed in each of said cylindrical bodies, said partition member extending in a transverse direction of said cylindrical bodies, a top cover being provided on an uppermost end of one of said cylindrical bodies having the smallest diameter and located at the top of said support pole, one of said cylindrical bodies having the largest diameter located at a lowermost end of said support pole being made to stand on a machine chamber;

b) said partition member of each cylindrical body having at least one guide slit having an arched shape formed of a straight line or a curved line;

c) said machine chamber having at least one wind-up roll for winding up a band-like plate having an arched cross-sectional shape coinciding with said slit, at least one band-like plate feed mechanisms for paying out and drawing back said band-like plate by pinching same, and a device for driving said mechanisms;

d) said band-like plate having an arched sectional shape being made to pass through said guide slit having an arched sectional shape and formed in each of said partition members, said band-like plate being connected at its upper end to said top cover or a bottom portion of said cylindrical body having the smallest diameter and located at the uppermost end of said support pole;

e) said support pole being extended by rotating said band-like plate feed mechanism in a normal direction to pay out said band-like plate from said wind-up roll and to thereby lift said smallest-diameter cylindrical body located uppermost end of said support pole, by drawing up the second cylindrical body circumscribed about said smallest-diameter cylindrical body with the upward movement of said smallest-diameter cylindrical body, and by successively drawing up each larger-diameter cylindrical body with the smaller-diameter cylindrical body in this manner; and f) said support pole being contracted by rotating said band-like plate feed mechanism in a reverse direction to draw back said band-like plate previously paid out, to wind up said band-like plate around said wind-up roll and to draw down the second cylindrical body circumscribed about said smallest-diameter cylindrical body with the downward movement of said smallest-diameter cylindrical body, and by successively drawing down each larger-diameter cylindrical body with the smaller-diameter cylindrical body in this manner.

2. An extension support unit according to claim 1, wherein said partition members comprise a fixed partition member provided as a bottom plate formed integrally with each cylindrical body at the lower end of same, and a movable partition member capable of moving upward or downward in the longitudinal direction of each cylindrical body.

3. An extension support unit according to claim 2, wherein slide engagement portions comprising a key and a key groove are formed on inner surface of each cylindrical body and the outer periphery of the corresponding one of a plurality of movable partition members inserted into the cylindrical body to prevent each partition member from inclining and from rotating relative to the cylindrical body.

4. An extension support unit according to claim 3, wherein each of said movable partition members inserted into said cylindrical bodies is positioned in the corresponding one of said cylindrical bodies by being connected with a coil spring or the like between the upper surface of the bottom plate of the corresponding larger-diameter cylindrical body and the lower surface of the bottom plate of the adjacent smaller-diameter cylindrical body, and by being moved to a predetermined position as the cylindrical body is extended, and the partition member is moved to and positioned on the bottom plate of the cylindrical body in which it is inserted, as the cylindrical body is retracted.

5. An extension support unit according to claim 4 wherein slide engagement portions comprising a key and a key groove are formed on inner and outer surfaces of said cylindrical bodies inserted in one into another to prevent said cylindrical bodies from rotating and from inclining relative to each other.

6. An extension support unit according to claim 5, wherein said band-like plate feed mechanism has at least one pair of band-like plate feed rolls capable of pressing and pinching said band-like plates having an arched sectional shape.

7. An extension support unit according to claim 6, wherein said band-like plate feed mechanism has said feed rolls arranged along the direction in which said band-like plates having an arched sectional shape is transported, the feed rolls disposed on each side are connected by an endless belt, and said band-like plates are pinched between endless belt surfaces.

8. An extension support unit according to claim 7, wherein said at least one band-like plate comprises a pair of band-like plates having an arched sectional shape, said pair of band-like plates being used with their convex surface or concave surfaces facing each other.

9. An extension support unit according to claim 8, wherein if the concave surfaces of said band-like plates face inward with respect to the center of the cylindrical bodies, said band-like plates are wound around said winding rolls so as to form a circular shape or, if the concave surfaces of said band-like plates face outward, said band-like plates are wound around said winding rolls so as to form a generally triangular shape.

10. An extension support unit according to claim 9, wherein said band-like plate has notches or holes arranged in the longitudinal direction of the band-like plate, and at least one of said band-like plate feed roll and said roll belt has a roll or belt surface with recesses and projections corresponding to said notches or holes.

11. An extension support unit according to claim 1, wherein slide engagement portions comprising a key and a key groove are formed on inner and outer surfaces of said cylindrical bodies inserted in one into another to prevent said cylindrical bodies from rotating and from inclining relative to each other.

12. An extension support unit according to claim 1, wherein said band-like plate feed mechanism has at least one pair of band-like plate feed rolls capable of pressing and pinching said band-like plates having an arched sectional shape.

13. An extension support unit according to claim 1, wherein said band-like plate feed mechanism has said feed rolls arranged along the direction in which said band-like plates having an arched sectional shape is transported, the feed rolls disposed on each side are connected by an endless belt, and said band-like plates are pinched between endless belt surfaces.

14. An extension support unit according to claim 1, wherein said at least one band-like plate comprises a pair of band-like plates having an arched sectional shape, said pair of band-like plates being used with their convex surface or concave surfaces facing each other.

15. An extension support unit according to claim 1, wherein said band-like plate has notches or holes arranged in the longitudinal direction of the band-like plate, and at least one of said band-like plate feed roll and said roll belt has a roll or belt surface with recesses and projections corresponding to said notches or holes.

* * * * *